United States Patent [19]

Somerville

[11] 4,140,929

[45] Feb. 20, 1979

[54] AIR PRESSURIZING SYSTEM

[75] Inventor: William M. Somerville, Newcastle upon Tyne, England

[73] Assignee: Clarke Chapman Limited, Gateshead, England

[21] Appl. No.: 766,726

[22] Filed: Feb. 8, 1977

[30] Foreign Application Priority Data

Feb. 14, 1976 [GB] United Kingdom ..... 5890/76

[51] Int. Cl.[2] ..... H01H 7/00

[52] U.S. Cl. ..... 307/326; 307/141; 361/1

[58] Field of Search ..... 307/326, 141, 141.4, 307/141.8, 326, 118; 361/1, 2, 23

[56] References Cited

U.S. PATENT DOCUMENTS 2,807,755 9/1957 Thayer et al. ..... 361/1

*Primary Examiner*—Robert K. Schaefer
*Assistant Examiner*—Morris Ginsburg

[57] ABSTRACT

An air pressurizing and purging system for electrical equipment contained in compartments with safety checks and interlocks ensuring inhibition of main power circuit completion until purging pressure and fan operation are verified by a timer for a set period.

System failure initiates a trip after a delay to open the main power circuit.

Re-energization of the main circuit requires full purge and verification procedure once more.

7 Claims, 6 Drawing Figures

AIR PRESSURIZING SYSTEM

BACKGROUND OF THE INVENTION

This invention arises especially in response to the demand for safety in electric cranes for oil drilling rigs. However, it is applicable to oil tanker cranes and to electrical equipment generally in hazardous environments involving fire risk.

BRIEF SUMMARY OF THE INVENTION

A system for air pressurising compartments for electrical apparatus including means ensuring purging the compartments and pressurisation of the compartments and air supply system and employing a timer which ensures that essential requirements for example: air purging of all compartments; air pressure in the system; and air supply fan running are all verified for a timed period before the power circuit for the apparatus can be closed.

DETAILED DESCRIPTION OF PREFERRED EMBODIMENTS

Figure 1:
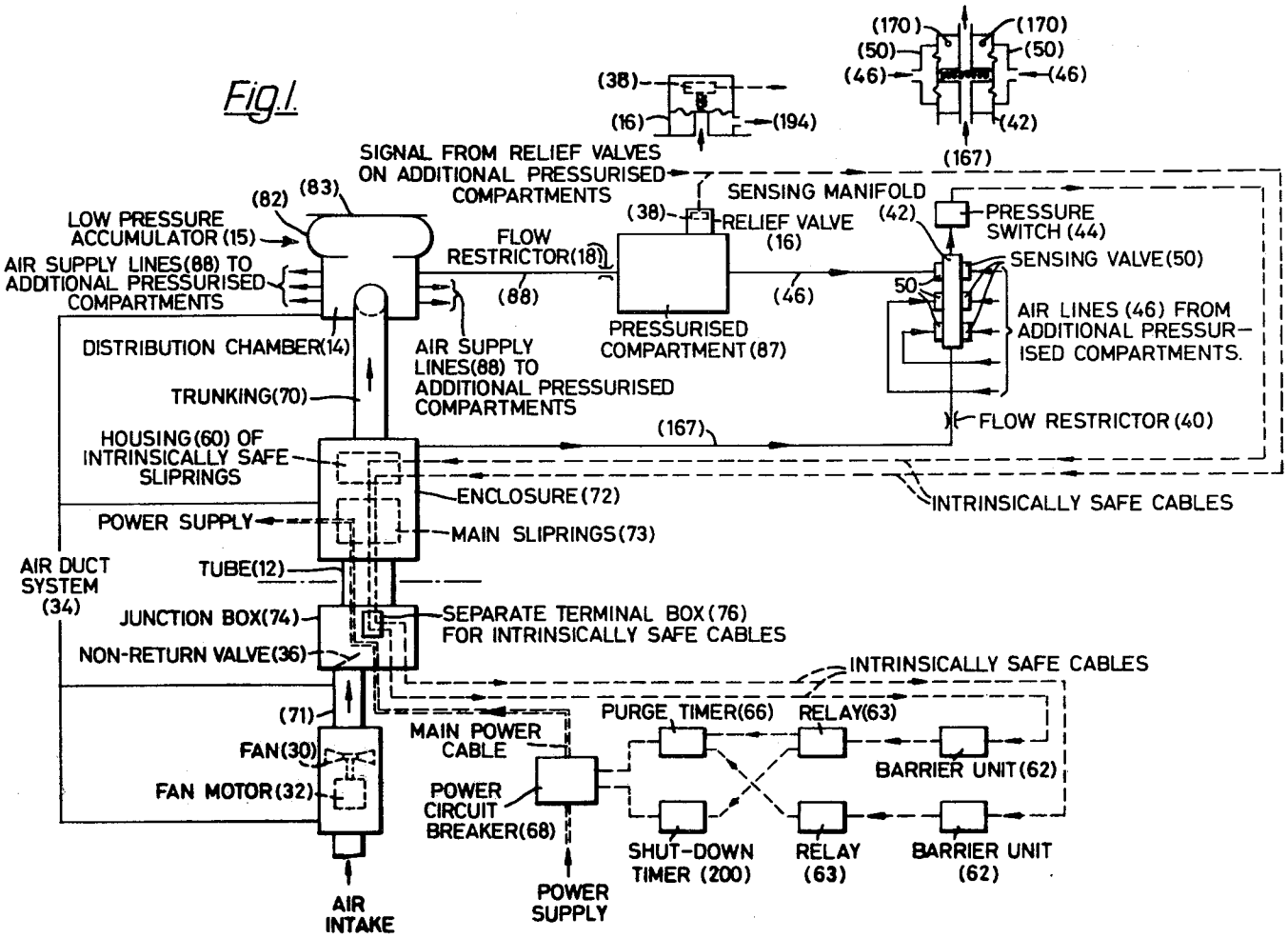
FIG. 1 is a schematic block diagram of the system.

FIG. 1 shows the system as a whole and is self-explanatory. The system shown provides:

1. Common low pressure air supply to purge and pressurise more than one compartment.
2. A flow control and pressure distribution system supplying several compartment from a common supply of clean dry air.
3. A low pressure, self purging accumulator to provide constant head make up air to maintain pressurisation in the event of supply failure.
4. A self sealing and self pressurising system to maintain pressurisation when purging and pressurising air supply is lost.
5. Self sealing low pressure relief valves with switch indication of minimum acceptable air flow.
6. A multi point pressurisation monitoring system with pneumatic amplification of the very low pressure signal to a level permitting reliable operation of pressure sensing switches.
7. The use of the electrical power slipring assembly as a swivel joint and air duct permitting the supply of pressurising air from a remote safe air supply to a multi compartment electrical system on a rotating structure.
8. The whole system with monitoring, safety sequence and interlocks to ensure safe operation. Including a circuit which locks out the system if the safety circuit is "shorted out".

GENERAL

The pressurising system affords protection against the possibility of ignition of inflammable gases by means of electrical sparking within any of the electrical equipment compartments fitted to apparatus such as a crane. The system will comply with the requirements of British Standard Code of Practice 1003 Pt2 (1966) and with the additional requirements of the Department of Energy set out in their draft Proposals for Offshore Installations (1973) Guidance Notes (Electrical).

The necessary protection is provided simply by interlocking the main power supply to the crane to a pressurisation and purging system so that no power may be applied until an adequate purge has been completed and all compartments are proven to be pressurised. In order to ensure that a satisfactory purge is being executed it is necessary to detect both pressure and flow of purging air in each individual compartment. This function is monitored by suitable pressure and flow sensing devices. Satisfactory flow and pressure conditions are indicated by switches in separate circuits operating at intrinsically safe power levels, each operating a remote relay via a barrier unit approved by the British Approval Society for electrical equipment in flammable atmospheres (B.A.S.E.E.F.A.) in a control unit adjacent to the main supply circuit breaker in a safe area.

Thus, until the electrical equipment in the system is pressurised and fully purged with clean dry air only intrinsically safe circuits can be energised.

A further safety measure is required in consideration of the special hazard which could arise should the crane be shut down due to a purging system failure, when a load was suspended from the hook.

The system is self sealing, in the event of fan failure, and capable of maintaining a positive internal pressure above the minimum of 12.5 mm w.g. stipulated by the Department of Energy for at least 10 minutes after failure of the purging fans. In such an event a separate circuit will give a warning signal to the crane driver and it will be encumbent upon the driver to dispose of any suspended load, as rapidly as possible with safety, within the 10 minute period allowed, after which the main supply circuit breaker will be tripped automatically. After such a shutdown it will be necessary to re-purge the crane system through a complete cycle before power can be restored to the crane, assuming that the system is then pressurising correctly.

Pressurisation is sustained in the event of fan failure by arranging for a non return valve at the air inlet to the crane system and by having all the compartment venting valves arranged to seal at a positive pressure well above the minimum required. Since the percentage overpressure is very small in all systems of this type a limited volume constant pressure accumulator has been added to the system to make up any air leakage through shaft seals for switches and controllers, etc., and to maintain internal pressure above the minimum of 12.5 millimeters water gauge (mm w.g.) within the 10 minute period stipulated.

The necessary controls to ensure the correct sequence for purging and shut down are grouped in a lockable enclosure mounted close to the main crane supply circuit breaker in a safe area on board ship. The use of shunt Zener diode intrinsically safe barrier units is conditional that certain maximum values for capacitance, inductance and resistance in the circuit within the hazardous area are not exceeded. If the characteristics of the I.S. circuit cable between the crane and the aforementioned control enclosure permit, the Zener barrier unit will be mounted within this locked enclosure. Alternatively, a separate enclosure for the barrier unit may be provided for location in a safe area between the main circuit breaker control and the crane pedestal. Due care will be taken to ensure adequate segregation of the intrinsically safe circuit cables from all other power cables and any junction boxes absolutely necessary will be duly marked to indicate the function of the circuit.

NORMAL SYSTEM OPERATION

The pressurising air supply will be drawn from a source of clean dry air in a safe zone on board the ship. The necessary volume and pressure at the point of entry to the crane will be provided by a fan 30, driven by a motor 32 installed in the duct system 34 in a safe area on the ship. When the pressurising fan is started an auxiliary contact on the fan starter will signal to the control unit monitoring the purging system that the fan is running. The fan will be so proportioned to deliver air to the connection point under the crane slew bearing at a pressure of 250 mm w.g. The minimum air flow rate required Department of the Environment requirements is 0.026 cubic meters per second (55 cubic feet per minute) to which an additional quantity of 0.071 cubic meters per second (150 cubic feet per minute) is added to provide cooling air to prevent heat build up at the control panel regulators. To ensure an adequate supply with a reserve in hand the purging air supply will be rated to deliver to the crane 0.142 cubic meters per second (33 cubic feet per minute) of air at 250 mm w.g.

When the fan 30 is started clean dry air will be admitted to the crane via the non-return valve 36 at the inlet point and will flow upwards through the duct system 34 which comprises a hollow tube 12, a housing 72, trunking 70, and a distribution chamber 14 and thence to a low pressure accumulator 15 in the roof of the crane. The main power cables for the crane now pass through the tube 12.

After allowing for a pressure drop through the non-return inlet valve 36 and the duct system 34 the working air pressure in the distribution chamber 14 will be approximately 200 mm w.g. When air is admitted the low pressure accumulator 15 will commence to charge to its maximum storage volume as soon as the pressure rises above 25 mm w.g. and when fully charged after a few seconds the working pressure will develop in the distribution system and pressurisation of the various compartments will build up via air lines 88 leading to them from the duct system 34.

As the pressure in each compartment 87 reaches a value of 75 mm w.g. the relief valves 16 will commence to open and excess pressure will be relieved to atmosphere in the machinery house which is, in turn, freely ventilated by louvres at floor and ceiling on either side. Due to pressure losses in the relief valve ducts the pressure in the compartments will rise to approximately 100 mm w.g. at the full purging rate. To ensure reliable operation relief valves 16 of the diaphragm amplifier type are used and the movement of the diaphragm to open the exhaust vent will be sensed by a microswitch 38 and used to indicate that a purging flow is present.

Air distribution in the correct proportions relative to the various compartment volumes is obtained by means of flow restrictions 18 in the individual distribution air lines 88 from the distribution chamber 14 to each enclosure. This ensures that the correct purging takes place in all compartments during the set purging time interval of 30 minutes.

Air is also fed from the distribution chamber 14 via a flow restrictor 40 to a sensing manifold 42 and, in turn, to a pressure switch 44 set to close at 200 mm w.g. Initially, pressure cannot develop in this manifold as the sensing diaphragm valves (described below) for each enclosure have not operated and thus the sensing manifold 42 is allowed to exhaust to atmosphere.

Figure 5:
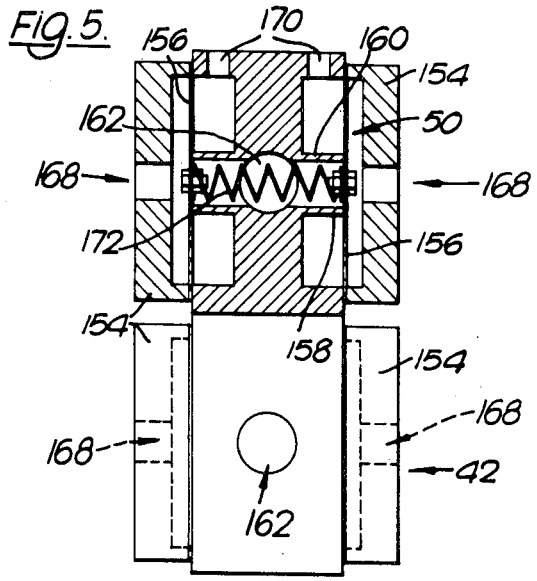
FIG. 5 is a schematic end elevation partly in section, of a valve assembly of the system.
Figure 6:
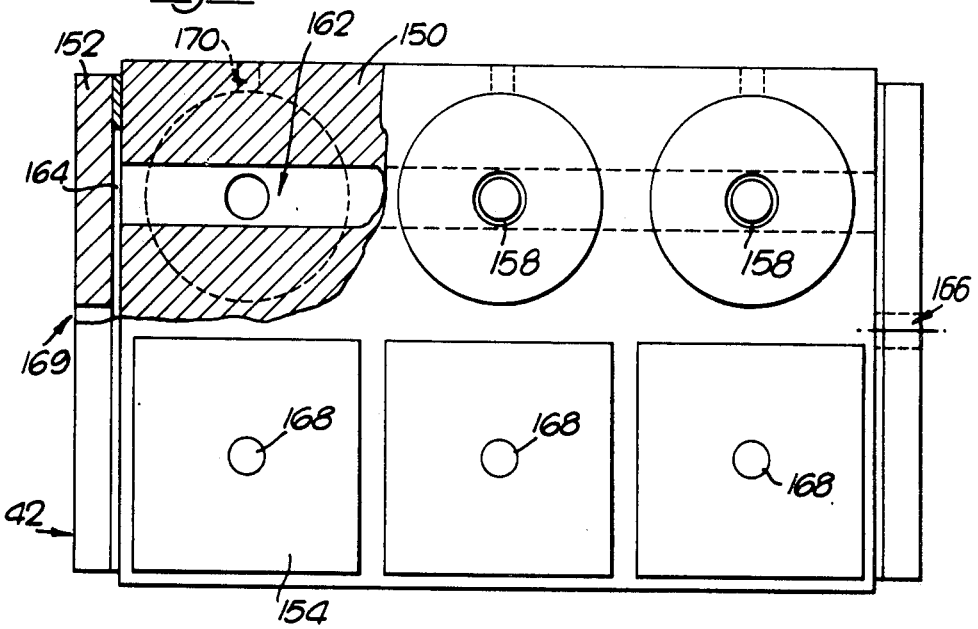
FIG. 6 is a schematic front elevation partly in section, of the valve assembly shown in FIG. 5.

As the pressure builds up for each compartment it is transmitted by air lines 46 to the appropriate one of an array of diaphragm sensing valves 50 forming part of a common assembly with the sensing manifold 42. When the pressure in a valve 50 reaches a value of 65 mm w.g. the corresponding diaphragm valve overcomes a light spring and seats against the annular valve seat at the end of a vent pipe in the valve. The pipe is connected to the sensing manifold 42 (FIGS. 1, 5 and 6).

When all the diaphragm sensing valves 50 are pressurised and closed pressure will build up in the sensing manifold 42 to approximately 200 mm. w.g. and the pressure switch 44 will close indicating that all compartments are pressurised.

When all the vent valves 16 are open and their switches 38 operated, a signal is available indicating that purging air is flowing through all compartments and this signal together with the signal from the pressure switch 44 are fed through their respective pairs of slip-rings in a separate intrinsically safe slipring enclosure 60 and thence via the segregated I.S. cable and their respective barrier units 62 to respective relays which provide control signals to a main circuit-breaker 68. When both these signals are available together with the "fan running" signal mentioned earlier, a purge sequence timer 66 commences running for a timing period of approximately 30 minutes. This timer 66 continues to run so long as all three signals are present and at the completion of the set time the circuit breaker 68 is closed. If, at any time during the purging sequence, one of the signals is lost the timer will reset and on resumption of all three signals will re-commence the timing sequence. Likewise, when the timing sequence is complete and the "permission to close" relay is set, this will also be released should there be a failure of any of the three signals prior to the circuit breaker being closed.

Once the circuit breaker 68 has been closed a different control sequence becomes effective to ensure the delayed trip for safety reasons mentioned ealier. The delay trip sequence will be started only by a loss of pressure signal to reduce the possibility of a spurious and possibly dangerous trip due to signals from the air flow and fan running circuits. The arrival of a pressure loss signal at a timer 200 will lock in a 10 minute trip sequence and power will be disconnected from the crane when the time period has elapsed regardless of whether pressurisation has been restored or not. Re-energisation of the crane will require the full purge sequence to be performed before the circuit breaker 68 can be re-closed.

AUXILIARY SUPPLIES

It should be noted that auxiliary supplies for jib lights, floodlights, etc., will be subject to the same restrictions as the main crane power supply and whether taken from the same supply circuit breaker or from a separate supply must be correctly interlocked to ensure that the auxiliary supply is isolated from the crane until the purging sequence and pressurisation system has proved the crane safe.

SYSTEM SEQUENCE OF FAN FAILURE

Should the pressurisation and purging air supply fail due either to a failure of the pressurising fan 30 or rupture of the supply duct before the crane connection point the non return valve 36 will immediately close preventing a discharge of the pressurised air into the supply duct 34. Air at pressure within the distribution chamber 14 will dissipate into the various compartments until the main distribution pressure has equalised and the pressure will continue to fall until the compartment pressure drops to the closing pressure of 75 mm w.g. of the relief valves 16 at which point the system will seal itself. The air in the sealed sensing manifold 42 which was at a pressure of 200 mm w.g. will dissipate via the supply restrictor 40 into the main distribution system allowing the pressure in the sensing manifold 42 to fall to a pressure of 75 mm w.g. which is well below the reset value for the pressure sensing switch 44 (nominally 135 mm w.g.) and a signal indicating that the pressurising system is defective will be passed to the timer 200. Simultaneously, a completely separate pressure switch (not shown) will initiate a self-holding cabin alarm, powered by the crane control system, thereby warning the driver that the pressurising system has failed and that he has 10 minutes to unload and make safe the crane. This is supplementary to the manometer gauge provided to indicate supply pressure at the drivers position.

The pressure will meanwhile continue to fall slowly due to small leaks until at a pressure of approximately 25 mm w.g. the low pressure accumulator 15 will commence to discharge retaining the system internal pressure at 25 mm w.g. until the store volume of air has been lost. With all seals and joints maintained in good condition and all doors properly closed this period will be in excess of the stipulated 10 minutes that the trip sequence requires.

The timer 200 is started in response to opening of the pressure switch 44.

The timer 200 runs for 10 minutes after which it produces a signal causing the circuit breaker 68 to open the main circuit and stop the crane or prevent operation of the crane, which the driver had already stopped in response to the warning.

SYSTEM OPERATION WITH A LOSS OF PRESSURISATION IN ONE ENCLOSURE

In the event that one of the compartments 87 is unsealed or ruptured the loss of pressure in that compartment below the closing pressure of 65 mm w.g. of the valve 16 will cause the valve 16 to open the vent port to the sensing manifold 42 allowing this to de-pressurise and causing the pressure sensing switch 44 to operate, thus initiating the shutdown sequence as described previously and again indicating to the driver that a fault has occurred on the pressurising system.

PROVISION FOR COMMISSIONING AND TEST

As mentioned earlier, the power supply circuit breaker interlocking relays and control sequence equipment is located in a lockable control enclosure mounted near the main circuit breaker 68. For convenience during commissioning and maintenance the purging system control sequence should be provided with a bypass circuit which can be engaged by means of a key operated switch under the control of a responsible authorised person. Such provision discourages the use of shorting links or other means which may be inadvertently left in place when the work is completed. As further protection the control equipment will be arranged, so far as is readily possible to 'lock out' should 'jumpers' be attached to the crane safety circuits.

SUPPLY OF PRESSURISING AIR

Air is supplied to the crane through a duct system 34 referred to above. The system contains the fan 30 driven by a fan motor 32 and includes a junction box 74, into which air enters via the valve 36. The valve 36 consists of a light flexible membrane framed and hinged over a perforated inlet plate and so constrained to be of self-closing when air delivery ceases. This form of construction permits an effective seal against return flow and prevents back pressure from straining the light membrane.

The box 74 houses the main power cable terminals 78 and terminals 76 for intrinsically safe control signal cables.

The box 74 is prevented from rotating with the rotatable crane structure by members 81 which are interconnected with the box 74 by flexible connecting means 85 and are secured at their lower ends (not shown) to part of the fixed structure of the crane.

The box 74 is connected at its upper end to an inner part 12A of the tube 12, the part 12A being also connected to the main crane power slipring assembly 73. An outer part 12B of the tube 12 is rotatable relative to the part 12A. The slipring assembly 73 does not rotate, being restrained from rotating by the tube part 12A, the box 74 and the members 81. Power is picked up from the sliprings by brushes (not shown) in conventional manner, the brushes sliding round the sliprings as the crane rotates. The slipring assembly 73 is housed in a watertight enclosure 72 which forms a further part of the duct system 34 and which is secured to the rotatable part of the crane structure.

The rotatable part of the crane structure is secured to the outer part 12B of the tube 12.

The air passing through the duct 34 passes also through the tube 12.

Figure 2:
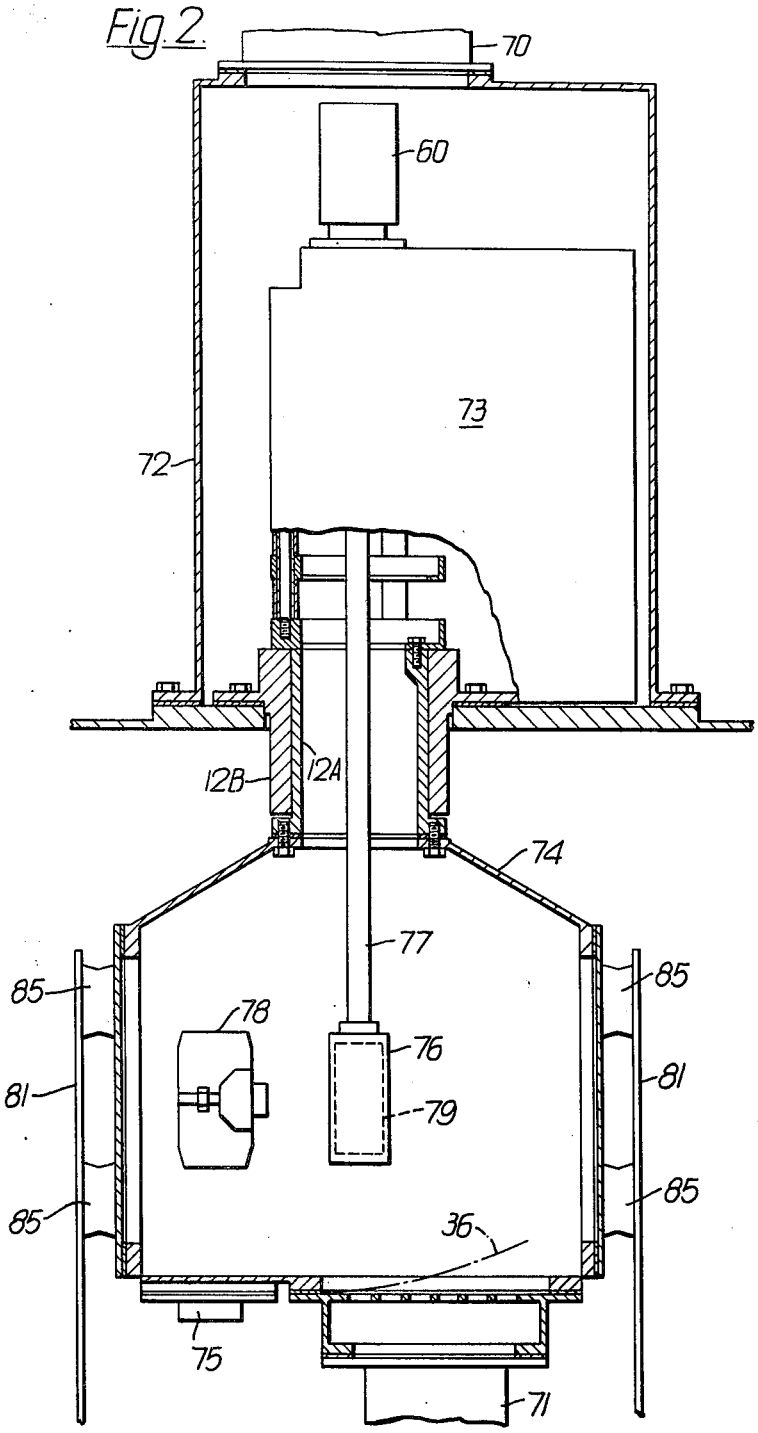
FIG. 2 is a schematic vertical section through the crane's collector gear.

The secondary slipring assembly is mounted on top of the main assembly 73 and is housed within its own intrinsically safe enclosure 60. An intrinsically safe 4-core screened cable is connected between the secondary slipring assembly and the terminals at 76 and passes through a tubular insulating sheath 77 (FIG. 2).

The secondary slipring assembly is a standard six ring assembly, though only four of these rings are allocated for the intrinsically safe control circuits.

The auxiliary sliprings are connected to the frame of the main sliprings 73.

A gland plate 75 is provided at the bottom of the box 74 where the armoured main power cable terminates and a separate gland 79 is provided for the intrinsically safe cables.

The duct system 34 is continued above the enclosure 72 by trunking 70 which leads to the distribution chamber 14.

Air passing upwardly through the duct system 34 sweeps over the slipring assemblies before passing through the trunking 70.

Small perturbations of the rotatable part of the crane relative to the fixed part are accommodated by the flexible connecting means 85 and by providing a flexible duct member 71 in the duct 34 between the box 74 and that part of the duct containing the fan 30.

COLLECTOR GEAR ASSEMBLY

The general arrangement of the collector gear assembly, including the inlet valve, is represented in FIG. 2. The general disposal of the various parts of this assembly can be clearly seen on the drawing. The collector gear main sliprings and torque tube are standard marine crane components of our manufacture. The housing of the upper portion is a standard watertight enclosure, used in this case to act as a collection box for air delivered through the torque tube. This enclosure also supports a secondary slipring assembly for the intrinsically safe circuits by which the purging flow and system pressure are proved to be present as described. A standard six ring assembly will be used although only four of these rings are currently allocated for these circuits. The drive to the stationary rings will be provided by means of a coupling to the frame of the power sliprings below and the connections to the intrinsically safe sliprings will be taken via a four core screened cable insulated overall to a separate terminal box within the main air inlet and power terminal box below. As an additional precaution this cable will be sleeved with insulating material where it passes down through the main power slipring assembly. A gland plate will be provided in the bottom of the lower chamber to permit the termination of armoured cable for the main power supply and a separate gland for intrinsically safe cables. As stated this lower chamber does not rotate but is subject to minor movements due to rotation of the crane above and flexure of the structure under the influence of load.

Air from this upper enclosure will be taken by sealed duct up to the main distribution manifold under the roof of the crane machinery enclosure.

MAIN AIR DISTRIBUTION SYSTEM AND LOW PRESSURE ACCUMULATOR

Figure 3:
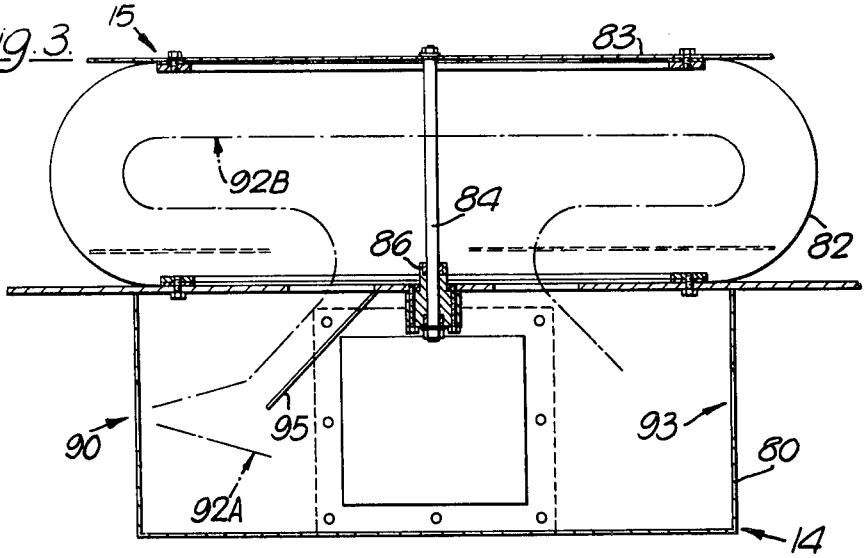
FIG. 3 is a schematic vertical section through an accumulator of the system.

The air distribution chamber 14 and low pressure accumulator 15 are located in the upper portion of the crane machinery house so as to afford the least obstruction to movement and access to the various items of machinery housed in this space. The low pressure accumulator 15 which is a loaded piston device of limited travel is shown in FIG. 3. Because of the low working pressures involved sliding seals cannot be used and the piston is sealed by means of a flexible membrane as shown. In order to protect the membrane the whole unit is enclosed within a cylinder 83. It can be seen that the accumulator fully discharges on loss of pressure so that there is no gas accumulating problem.

Air distribution from the chamber 14 is by means of screwed metallic conduit sized in proportion to the flow required to the individual enclosures and where necessary provided with additional flow restrictors to give a pressure drop of 75–100 mm w.g. at the required flow of purging air to the enclosures.

The accumulator 15 consists of a membrane 82 with a top plate 83 secured to a rod 84 which slides in a bearing 86. The accumulator is located on top of the distribution chamber 14.

Purging air enters the chamber 14 from the trunking 70 through an inlet 90 and passes in part as shown by the arrow 92A directly to outlets such as 93. The remainder of the air flow is deflected upwardly by a plate 95 and passes as indicated at 92B as scavenging flow through the space within the diaphragm 82 and thence to the compartments 87 via the outlets 93 and the duct lines 88 (FIG. 1).

PRESSURE RELIEF VALVES

Figure 4:
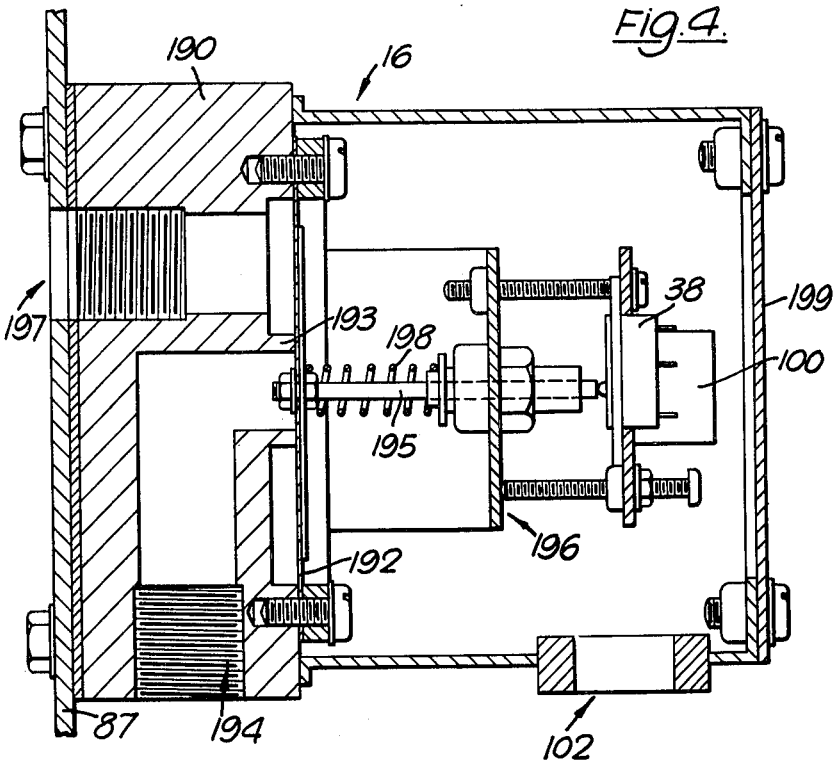
FIG. 4 is a schematic vertical section through a pressure relief valve of the system.

Two sizes of pressure relief valve 16 will be used, the smaller as shown in FIG. 4 will be used on compartments up to 0.3 cubic meter volume and the larger (not shown) will be used on volumes up to 1.5 cubic meters such as the control panels. These valves are of a "differential design" so that a large area is available to provide sufficient opening force at the low pressures used with practical closing spring pressure to make a good airtight seal when the valve is shut. Tests on this type of valve indicate that it has a consistent shut off performance and a low excess pressure at the venting flow rates required. A definite movement of the diaphragm occurs when the valve is venting at the required rate and this permits ready indication that an effective purging flow is available by means of the microswitch 38 as shown on the drawing.

The pressure relief valves 16 will generally be mounted on the wall of the compartment being vented except in the case of the compartments in the driver's cabin where it was stipulated that these compartments are to discharge into the main machinery compartment.

For these compartments and the main roof mounted generator compartment, the relief valves 16 will be bulkhead mounted in the main machinery compartment.

FIG. 4 shows part of a wall of a compartment 87 to which is secured a housing base 190 which has a valve seat 193 communicating with a vent 194. The housing base 190 has a further vent 197 communicating with the interior of the compartment 87. The housing base 190 carries a cover 199 which contains a diaphragm 192 cooperating with the valve seat 193. The diaphragm 192 is connected to a rod 195, which can actuate the switch 38 (a microswitch). The rod 195 is guided by a guide assembly 196 and is surrounded by a return spring 198. The switch 38 has a terminal block 100 and an intrinsically safe cable (not shown) connected to the switch 38 passes through a hole 102 in the cover 199.

DIAPHRAGM SENSING VALVES

As mentioned earlier the pressure sensing diaphragm valves 50 are grouped together on the main pressure sensing manifold 42 in order that the latter may have the minimum volume to ensure rapid response of the pressure switch 44 with the smallest practicable flow from the distribution chamber 14. Connection to the various compartments will be by means of a small bore nylon tubing with plasticon connectors (suitable for pressures up to 200 psi) a part sectioned general assembly of this unit is shown in FIGS. 5 and 6. The valve 50 has internal bias by means of a light spring to ensure that the vent pipe connection to the sensing manifold 42 is opened smartly when the sensing manifold pressure falls below the required value of 65 mm water gauge. Again, the differential area of this valve ensures that when the pressure is sufficient, to overcome the spring, adequate force is available to seal the sensing manifold vent port effectively.

In FIG. 5 the end over is shown removed and in FIG. 6 the side covers are shown partly removed.

The valves 50 are arranged in a manifold common housing 150 having end covers 152 and side covers 154. Each valve 50 comprises a valve diaphragm 156 cooperating with an annular valve seat 158 at an end of a tube 160. The tube 160 communicates with a bore 162 through the housing 150. The ends of the bore open into chambers 164 between the covers 152 and the housing 150. An inlet at 166 connects the bores 162 to the high pressure air line 167 (FIG. 1) leading from the air supply tube duct system 34. The compartments 87 (FIG. 1) are connected by the lines 46 at respective inlets 168. A connection at 169 leads to the switch 44 (FIG. 1). The housing 150 is vented at ports 170 to atmosphere.

A compression return spring 172 is positioned between every two opposed diaphragms 156.

The valve 50 closes when the pressure in the compartments 87 reach 65 mm water gauge. The pressure in the manifold 42 then builds up to 200 mm w.g. The pressure switch 44 closes when 200 mm w.g. pressure is reached in the manifold. Failure of any one compartment 87 to reach its required pressure level will prevent closure of the pressure switch 44. The compartment relief valves 16 open at a pressure of 100 mm w.g. (or at some other value up to 150 mm w.g. say if preferred).

BARRIER UNIT

It is proposed that a B.A.S.E.E.F.A. approved intrinsically safe shunt Zener diode barrier unit be used at 62 (FIG. 1) to supply intrinsically safe circuits within the hazardous area, a suitable unit being Measurement Technology Limited Barrier Unit, type MTL 188+ which has a 28 volt channel and a 10 volt channel. The main advantage of this particular type of unit is that it will indicate a mal-function should either side of the intrinsically safe circuit to the switch in the hazardous area go down to earth thereby preventing incorrect signals due to faults on the intrinsically safe circuits.

POWER AND CONTROL CABLE SEALING AND PROTECTION

Main power cables will be sealed at the point of entry to various compartments by cable glands or equivalent and mechanically protected throughout their run by means of either heavy gauge steel trunking or fabricated enclosures. Control cables will be run in heavy gauge screwed conduit sealed by stopper glands or stuffing boxes as appropriate.

COMPARTMENT SEALING

Special attention will be given to the sealing details of all electrical compartments with particular reference to the operating shafts of control members to ensure that an efficient and reliable seal is obtained.

PHYSICAL PRECAUTIONS AND SAFEGUARDS

All bolted doors and cover plates permitting access to electrical compartments will be provided with a minimum of 2 special sealing bolts requiring a special key to release them.

Control panels will be provided with hinged sheet metal doors having at least 2 lockable latches effectively preventing the door from being unsealed. Additional non locking latches will be provided as necessary to ensure even compression of the door joint seal.

All electrical compartments will be provided with the required warning label, so that it is readily visible by anyone wishing to inspect the equipment.

M.G. SETS

A number of typical Motor Generator Set assemblies were pressurised and the rate of pressure decay recorded. These results indicate that there would be no problem in maintaining pressure on these particular units.

MOTORS

A number of typical marine motor assemblies of sizes typical to those required on this crane were tested as manufactured without special preparation. The loss of pressure with time in this case is more rapid due to a small but definite leak at the shaft seal. At the time of test these shaft seals were dry and whilst there is no doubt that a better seal would be obtained had these been saturated with oil as in the normal working condition the general indication is that some provision would have to be made to provide air to compensate for increased leakage as the seal wore after a period of running.

PANELS

The pressurising tests were also carried out on standard marine panels to determine both the leakage rate and the amount of distortion when the panel was pressurised. Since the standard panel is a drip-proof design it was not surprising that an unexpectedly high leakage rate was found, pressure falling from 150 mm to 5 mm water gauge in just under 1 minute. The main problem here lay in the manner of construction of the cabinet and in the detail of the door seal. The control panels for this crane will have all joints fully welded and special compression seals will be fitted to the doors. A slight distortion, (ballooning), of our standard panel was noted at internal pressures of 150 mm water gauge and additional stiffening will be provided on the panels for this crane to prevent this effect, also sufficient latches will be provided on the doors to ensure an even clamping force is available throughout the length of the door sealing joints.

CONTROLLERS

The standard marine controller in use is designed mainly for convenience of access and it was found impossible to pressurise the standard assembly. The main difficulty here lay in the framework of the pedestal with doors fitted to provide all round access. The standard controller will be used on this crane but will be provided with a special pedestal having a much better sealing arrangement with some loss of accessibility.

What I claim is:

1. An air pressurising system for electrical apparatus comprising:

(a) compartment means;
(b) air supply means;
(c) air accumulator means;
(d) air supply duct means leading from said air supply means to said air accumulator means;
(e) first air lines connecting said compartment means to said air supply duct means;
(f) each said compartment means having a pressure relief valve openable at a predetermined first pressure and having first check means operable in response to opening of said pressure relief valve;
(g) manifold means;
(h) vent means defining air exits from said manifold means;
(i) pressure responsive comparator valve means operable to close said vent means upon difference between pressures in all said compartment means and said manifold means falling to a predetermined value;
(j) second air lines connecting said compartment means to said pressure responsive valve means;

(k) a third air line connecting said air supply duct means to said manifold means;

(l) second check means operable in response to a second value of air pressure in said manifold means higher than said first pressure;

(m) power circuit breaker means operable to pass power to said electrical apparatus;

(n) timer means;

(o) intrinsically safe circuit means connecting said first and second check means to said timer means which is operable in response to operation of said first and second check means to time a purge period and after said purge period has elapsed to initiate closure of said power circuit breaker means;

(p) and restrictor means in at least some of said air lines.

2. An air pressurising system according to claim 1, in which said air supply duct means comprises passes between a first structure on which said air supply means, said timer means and said power circuit breaker means are supported and a second structure rotatable relatively to said first structure, said accumulator means and the remainder of said system being supported on said second structure.

3. An air pressurising system according to claim 1, in which said pressure responsive valve means each comprise diaphragm means arranged in a housing which contains an annular valve seat with which said diaphragm means cooperates, a respective one of said second air lines being connected to the interior of said housing and said third air line being connected to the interior of said valve seat, and said housing including means defining a port to atmosphere communicating with a side of said diaphragm means remote from said respective one of said second air lines.

4. An air pressurising system according to claim 1, in which said restrictor means are in each of said first air lines and in said third air line.

5. An air pressurising system according to claim 1, in which a shut-down timer means is provided and is operable to time a shut-down period in response to re-set operation of said second check means upon air pressure in said manifold means falling below said second value, said shut-down timer means being operable after said shut-down period has elapsed to initiate opening of said power circuit breaker means.

6. An air pressurising system according to claim 1 in which said air supply means comprises an electric motor, said system comprising monitor means monitoring operation of said electric motor and in which said timer means is operable to time said purge period only only where said monitor means confirms operation of said electric motor.

7. An air pressurising system according to claim 1, in which said air supply means comprises a fan and motor in driving relationship therewith, at least said fan being positioned in said air supply duct means and in which there is provided a one-way valve means in said air supply duct means downstream of said fan and upstream of said first air lines and said third air line.

* * * * *